US009514684B2

(12) United States Patent
Tsubakino et al.

(10) Patent No.: US 9,514,684 B2
(45) Date of Patent: Dec. 6, 2016

(54) DISPLAY DRIVER

(71) Applicant: Synaptics Japan GK, Tokyo (JP)

(72) Inventors: Keita Tsubakino, Tokyo (JP); Kiichi Makuta, Tokyo (JP); Toshikazu Arai, Tokyo (JP); Yoshinori Ura, Tokyo (JP)

(73) Assignee: Synpatics Display Devices GK, Tokyo (JP)

( * ) Notice: Subject to any disclaimer, the term of this patent is extended or adjusted under 35 U.S.C. 154(b) by 0 days.

(21) Appl. No.: 14/331,612

(22) Filed: Jul. 15, 2014

(65) Prior Publication Data

US 2015/0022562 A1 Jan. 22, 2015

(30) Foreign Application Priority Data

Jul. 16, 2013 (JP) ..... 2013-147324

(51) Int. Cl.
*G09G 3/20* (2006.01)
*G09G 3/36* (2006.01)
*G09G 3/32* (2016.01)

(52) U.S. Cl.
CPC .... *G09G 3/3275* (2013.01); *G09G 2310/0289* (2013.01); *G09G 2360/18* (2013.01); *G09G 2370/08* (2013.01)

(58) Field of Classification Search
CPC ..... G09G 3/3648; G09G 3/2003; G09G 3/3275; G09G 2370/08; G09G 2360/18; G09G 2310/0289; G09G 3/20; G09G 3/36
See application file for complete search history.

(56) References Cited

U.S. PATENT DOCUMENTS 7,068,098 B1 * 6/2006 Bell ..... H03F 3/45192 327/309
2009/0262146 A1 * 10/2009 Hashimoto ..... G09G 3/3688 345/690
2011/0057924 A1 * 3/2011 Yanai ..... G09G 3/3677 345/212
2011/0063200 A1 * 3/2011 An ..... G09G 3/3688 345/98
2011/0216052 A1 * 9/2011 Tanaka ..... G09G 5/00 345/209
2013/0016087 A1 * 1/2013 Kishikawa ..... H03F 3/3022 345/212
2013/0141403 A1 * 6/2013 Shibuya ..... H03K 5/15 345/204

FOREIGN PATENT DOCUMENTS

JP 2010-102146 A 5/2010

* cited by examiner

*Primary Examiner* — Md Saiful A Siddiqui
(74) *Attorney, Agent, or Firm* — Miles & Stockbridge P.C.

(57) ABSTRACT

A gradation voltage corresponding to a display data is input to a signal electrode driving circuit. The signal electrode driving circuit includes a voltage output circuit which outputs a drive voltage corresponding to the input gradation voltage, and a slew rate assist circuit which accelerates a transition of an output voltage of the voltage output circuit. The slew rate assist circuit accelerates the transition of the output voltage after a predetermined time from a start of transition of the gradation voltage.

9 Claims, 6 Drawing Sheets

DISPLAY DRIVER

CROSS-REFERENCE TO RELATED APPLICATIONS

The Present application claims priority from Japanese application JP 2013-147324 filed on Jul. 16, 2013, the content of which is hereby incorporated by reference into this application.

BACKGROUND

The present invention relates to a display driver, and particularly to a display driver which is coupled to a liquid crystal display panel.

A liquid crystal display driver outputs a gradation voltage in accordance with display data to a signal line (source line) which is arranged so as to intersect a scan line (gate line) of a liquid crystal display panel. As a technology which pre-charges the source line, there is a technology described in JP-A-2010-102146. According to this, separately from a source line driver which drives the source line from one end thereof in accordance with the display data, a pre-charge driver which pre-charges the source line from the other end thereof is employed. The pre-charge driver compares drive data of the source lines, and pre-charges the source line by selecting one pre-charge voltage out of selection candidate pre-charge voltages of equal to or greater than four types in accordance with the comparison result. This is intended to cope with an increase of a source line load accompanying a resolution or a large size of a display screen.

SUMMARY

The present inventor has reviewed an influence of noise occurring when a transition such as a rise or a fall of a drive voltage accompanying source line driving is made. For example, if a capacitive type touch panel is arranged so as to overlap a liquid crystal display panel, there is a concern that detection accuracy may be decreased by the influence of the noise occurring according to the source line driving. In order to solve this problem, by pre-driving the source line before driving performed by the display data is performed, it is possible to suppress a noise peak value at the time of the transition of each drive voltage, and to reduce the influence of the noise on a peripheral circuit of the touch panel or the like.

Thus, the present inventor has invented the technology described in Japanese Patent Application No. 2012-239101 which is an unpublished prior application made by the applicant of the present application. The technology is a technology of pre-driving a drive terminal by converting pre-drive data according to a difference degree between present display data and previous display data into a predetermined value of a gradation voltage using a voltage output circuit, before the drive terminal is driven by converting the display data into the gradation voltage using the voltage output circuit of the source line driving. According to the technology, since the drive terminal is pre-driven by converting the pre-drive data into the predetermined value of the gradation voltage using the voltage output circuit, a pre-drive voltage output circuit which generates and outputs the pre-drive voltage separately from the voltage output circuit, is not necessary.

However, as a result of further study performed by the present inventor, it was found that there is a possibility that the following problems may occur, if the technology is applied to a display driver which is able to drive a display panel with a further higher resolution.

Since a recent display panel has a high resolution of up to 4K×2K, Wide-Quad-XGA (WQXGA; 1600RGB×2560) or the like, and in a display drive integrated circuit (IC) which is coupled to the display panel, a drive terminal for driving a source line and a voltage output circuit generally are arranged in parallel on one side of the IC, a pitch of the arrangement tends to be significantly narrowed. In the technology described in the above-described prior application, the difference degree between the present display data and the previous display data is obtained by a digital circuit. The digital circuit, that is, a logic circuit is suitable for miniaturization, but the display data, which improves a resolution, also has a possibility of increasing of the number of bits, a display speed and the like, and is not limited to such that can be necessarily adapted to the narrow pitch.

For this reason, it is obvious that a new problem in which the noise peak value at the time of a transition of each drive voltage is suppressed occurs, without a large scale logic circuit being used.

Units used for solving such a problem are described as follows, but other problems and new features will be apparent from the description of the present specification and the accompanying drawings.

One embodiment according to the present invention is as follows.

That is, in a display driver including a signal electrode driving circuit which receives a gradation voltage corresponding to display data and outputs a drive voltage corresponding to the gradation voltage to a signal electrode of a display panel, the signal electrode driving circuit includes a voltage output circuit which outputs a drive voltage corresponding to the input gradation voltage, and a slew rate assist circuit which accelerates a transition of an output voltage of the voltage output circuit, and the slew rate assist circuit starts the acceleration of the transition of the output voltage after a predetermined time has elapsed from the start of transition of the gradation voltage.

Advantages obtained by the one embodiment can be briefly described as follows.

That is, it is possible to provide a display driver including a signal electrode driving circuit which suppresses a noise peak value at the time of a transition of each drive voltage, without a large scale logic circuit being used.

DETAILED DESCRIPTION

1. Summary of the embodiments

Figure 1:
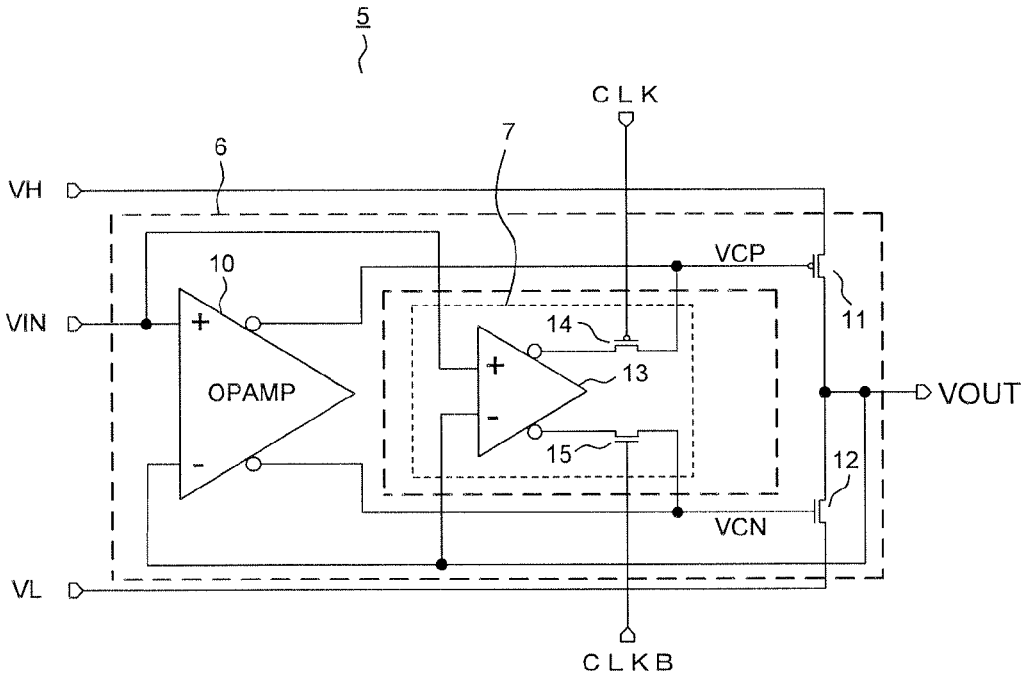
FIG. 1 is a circuit diagram illustrating a configuration example of a source amplifier according to one embodiment of the present invention.

First, summary of representative embodiments of the invention disclosed in the application will be described.

Reference numerals in drawings in parentheses referred to in description of the summary of the representative embodiments just denote components included in the concept of the components to which the reference numerals are designated.

[1] <Starting by Delaying Slew Rate Assist>

A display driver (1) according to a representative embodiment of the present invention includes a plurality of drive terminals (3 and 3_1 to **3_*m*) which are coupled to signal electrodes of a display panel, and a signal electrode driving circuit (2**), and is configured as follows.

The signal electrode driving circuit is coupled to each of the plurality of drive terminals, receives a gradation voltage corresponding to display data, outputs a drive voltage corresponding to the gradation voltage to the drive terminals, and is configured so as to include a plurality of source amplifiers (5 and 5_1 to **5_*m***).

The source amplifier includes a voltage output circuit (6) which outputs the drive voltage corresponding to an input gradation voltage, and a slew rate assist circuit (7) which accelerates a transition of an output voltage of the voltage output circuit. The slew rate assist circuit, after standing by for a predetermined time period from a start of transition of the gradation voltage, starts the acceleration.

As a result, it is possible to provide the display driver (1) including the source amplifiers (5 and 5_1 to **5_*m***) which suppress a noise peak value at the time of a transition of each drive voltage, without a large scale logic circuit being used.

[2] <Driving Transistors on Positive Polarity Side and Negative Polarity Side>

In section 1, the voltage output circuit includes a positive polarity side output transistor (11), a negative polarity side output transistor (12), and a first amplification circuit (10). The positive polarity side output transistor is coupled between a positive polarity side power supply (VH) and the drive terminal (VOUT), and the negative polarity side output transistor is coupled between a negative polarity side power supply (VL) and the drive terminal (VOUT). The first amplification circuit receives the gradation voltage, and outputs a positive polarity side control signal (VCP) which controls a control electrode of the positive polarity side output transistor and a negative polarity side control signal (VCN) which controls a control electrode of the negative polarity side output transistor.

The slew rate assist circuit is configured in such away that transitions of the positive polarity side control signal and the negative polarity side control signal can be accelerated.

As a result, it is possible to realize the source amplifier (5) which suppresses the noise peak value at the time of the transition of the drive voltage using a simple analog circuit.

[3] <On and Off Control of Slew Rate Assist Circuit>

In section 2, the slew rate assist circuit receives a positive polarity side clock (CLK) and a negative polarity side clock (CLKB), and controls whether or not to accelerate the transition of the positive polarity side control signal based on the positive polarity side clock, and controls whether or not to accelerate the transition of the negative polarity side control signal based on the negative polarity side clock.

As a result, it is possible to control turning on and off of the slew rate assist circuit (7) using a simple circuit.

[4] <Control of Time Period Until Acceleration Start Using Clock Pulse Width>

In section 3, the slew rate assist circuit starts the acceleration of the transition of the positive polarity side control signal after a time period of a pulse width of the positive polarity side clock has elapsed from the start of transition of the gradation voltage, and starts the acceleration of the transition of the negative polarity side control signal after a time period of a pulse width of the negative polarity side clock has elapsed.

As a result, it is possible to independently control the turning on and off of the slew rate assist circuit (7) on a positive polarity side and a negative polarity side, and to adjust in such a way that characteristics of the positive polarity side and the negative polarity side are symmetrical.

[5] <Clock Pulse Width Adjusting Circuit>

In section 4, the display driver (1) includes a first register (16) which can designate the pulse width of the positive polarity side clock, a first pulse width adjusting circuit (18) which adjusts the pulse width of the positive polarity side clock based on a parameter which is stored in the first register, a second register (17) which can designate the pulse width of the negative polarity side clock, and a second pulse width adjusting circuit (19) which adjusts the pulse width of the negative polarity side clock based on a parameter which is stored in the second register.

As a result, it is possible to independently and easily set a time period until the slew rate assist circuit (7) starts the acceleration of the transition, on the positive polarity side and the negative polarity side, and to adjust in such a way that the characteristics of the positive polarity side and the negative polarity side are symmetrical.

[6] <Configuration of Signal Electrode Driving Circuit>

In any one of sections 1 to 5, the signal electrode driving circuit includes the plurality of source amplifiers, a plurality of gradation voltage selection circuits (8_1 to **8_*m*) which are coupled to the plurality of source amplifiers and supply a plurality of gradation voltages with a plurality of potential levels to each of the plurality of source amplifiers, and a plurality of level shifters (9_1 to 9_*m***) which are coupled to the plurality of gradation voltage selection circuits and convert levels of digital values of the display data and supply the converted digital values to each of the plurality of gradation voltage selection circuits.

The plurality of gradation voltages are supplied to the plurality of gradation voltage selection circuits, and the gradation voltage selection circuit selects, based on the digital value of the display data which is supplied to each of them, one potential level out of the plurality of gradation voltages supplied and supplies the selected potential level to the coupled source amplifier.

As a result, it is possible to configure the signal electrode driving circuit (2) that includes the source amplifiers (5_1 to **5_*m*), the gradation voltage selection circuits (8_1 to 8_*m*), and level shifters (9_1 to 9_*m*) for each of the plurality of drive terminals (3_1 to 3_*m***) which are coupled to signal electrodes to be driven.

[7] <Embedding of Signal Electrode Driving Circuit>

In section 6, in the display driver, the plurality of source amplifiers, the plurality of gradation voltage selection circuits, and the plurality of level shifters are formed together on the same semiconductor substrate and have the same pitch as the plurality of drive terminals.

As a result, a high breakdown voltage area in which output portions of the source amplifiers, the gradation voltage selection circuits, and the level shifters are arranged, and a low breakdown voltage area in which input portions of the level shifters and a digital circuit such as a line latch circuit which inputs the display data to the level shifters are formed, are efficiently laid out without overlapping with each other.

[8] <Source Amplifier with Slew Rate Adjustment Function>

The display driver (1) according to a representative embodiment of the present invention includes the plurality of drive terminals (3 and 3_1 to **3_*m*) which are coupled to the signal electrodes of the display panel, and the signal electrode driving circuit (2**), and is configured as follows.

The signal electrode driving circuit includes the plurality of source amplifiers (5 and 5_1 to **5_*m***) which are coupled to each of the plurality of drive terminals, receive the gradation voltages corresponding to the display data, and output the drive voltages corresponding to the gradation voltages to the drive terminals.

The source amplifier controls in such a way that a current drive capability with respect to the drive terminal during first time period (t1 to t2 or t5 to t6) after an output start (t1 or t4) of the drive voltage is lower than a current drive capability with respect to the drive terminal during second time period (t2 to t4 or t6 to t8) before the drive voltage reaches a drive voltage corresponding to the gradation voltage after the first time period.

As a result, it is possible to provide the display driver (1) including the source amplifiers (5 and 5_1 to **5_*m*) which suppress the noise peak value at the time of the transition of each drive voltage, without the large scale logic circuit being used. During the first time period immediately after the output start of the drive voltage, the current drive capability of the source amplifier (5) is suppressed so as to be low, thereby suppressing a peak value of an inrush current flowing through the signal electrodes (3 and 3_1 to 3_*m*) of the display panel, and during the second time period thereafter, the current drive capability of the source amplifier (5**) is made high, thereby controlling the slew rate to be increased, in such a way that the signal electrode of the display panel reaches a drive voltage of gradation corresponding to the display data within a predetermined time period. The noise peak value is determined by a drive current of the source amplifier, and thus it is possible to suppress the noise peak value so as to be low, by suppressing the peak value so as to be low by averaging the magnitude of the drive current.

[9] <Slew Rate Assist Circuit>

In section 8, the source amplifier includes the voltage output circuit (6) which outputs the drive voltage (VOUT) corresponding to the input gradation voltage, and the slew rate assist circuit (7) which accelerates the transition of the output voltage of the voltage output circuit. The source amplifier stops the slew rate assist circuit during the first time period and operates the slew rate assist circuit during the second time period.

As a result, it is possible to provide the display driver (1) including the source amplifier (5) which suppresses the noise peak value at the time of the transition of each drive voltage, without the large scale logic circuit being used.

[10] <Slew Rate Assist Stop Period of Positive Polarity Side and Negative Polarity Side>

In section 9, the display driver further includes the first register (16) that when the transition of the output voltage rises, defines a length of the first time period during which the slew rate assist circuit stops, and the second register (17) that when the transition of the output voltage falls, defines the length of the first time period during which the slew rate assist circuit stops.

As a result, it is possible to independently control the stop period of the slew rate assist circuit on the positive polarity side and the negative polarity side, and to adjust in such a way that the characteristics of the signal electrode driving circuit on the positive polarity side and the negative polarity side are symmetrical.

2. Further Detailed Description of the Embodiments

Further detailed description of the embodiments will be made

Figure 2:
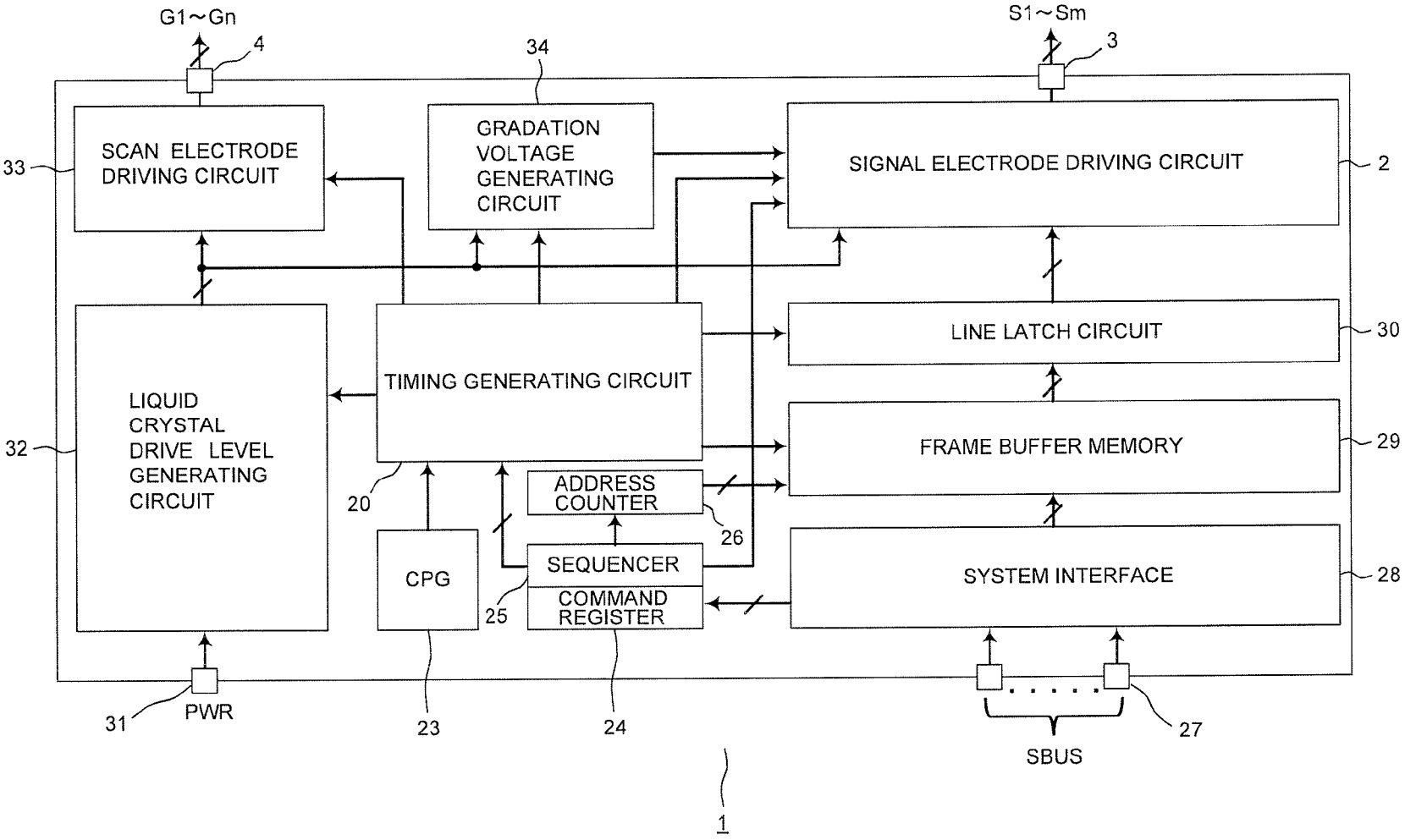
FIG. 2 is a block diagram illustrating a configuration example of a display driver according to the one embodiment of the present invention.

FIG. 2 is a block diagram illustrating a configuration example of a display driver 1 according to the one embodiment of the present invention.

The display driver 1 includes a scan electrode drive terminal 4, a drive terminal 3, system bus terminals 27, and a power supply terminal 31, is coupled to, for example, a liquid crystal display panel (not illustrated) via the scan electrode drive terminal 4 and the drive terminal 3, and is coupled to a system bus SBUS of, for example, a host processor (not illustrated) via the system bus terminals 27. The display driver 1 applies the drive voltage output from the drive terminal 3 to a liquid crystal pixel which is designated by a scan pulse output from the scan electrode drive terminal 4, based on the display data input from the host processor.

The liquid crystal display panel which is coupled to the display driver 1, although not particularly limited, is a dot matrix type panel in which multiple display pixels are arranged in a matrix shape. The liquid crystal display panel has scan electrodes (gate lines) and signal electrodes (source lines) which are arranged in a matrix shape, and a thin film transistor (TFT) switch is formed at an intersection portion thereof. The scan electrode is coupled to a gate of the TFT switch, and the signal electrode is coupled to a drain thereof. A liquid crystal pixel electrode of liquid crystal capacitance formed by a sub pixel is coupled to a source side of the TFT switch, and an electrode on an opposite side of the liquid crystal capacitance is a common electrode. The drive voltage output from the drive terminal 3 of the display driver 1 is supplied to the signal electrodes S1 to Sm. Gate electrodes G1 to Gn are driven by scan pulses applied, for example, in arrangement sequence from the scan electrode drive terminal 4 of the display driver 1.

A touch panel used as a further input device may be stacked over the liquid crystal display panel. The touch panel is a mutual capacitance type touch panel which can detect multi-touch, and includes a plurality of intersection portions which are formed by a plurality of touch drive electrodes and a plurality of touch detection electrodes. A touch panel controller which is coupled to the touch panel supplies drive pulses in sequence to the touch drive electrodes, and thereby detection data to correspond to the variation of a capacitive coupling state in each intersection portion is obtained, based on signals which are obtained in sequence from the touch detection electrodes.

The display driver 1 is coupled to the system bus SBUS of, for example, the host processor which is not illustrated via the system bus terminals 27. Although not particularly limited, the host processor produces display data, and the display driver 1 performs display control in order to display the display data received from the host processor on the liquid crystal display panel. If the touch panel is a stacked structure, the host processor acquires position coordinate data when a contact event occurs, and interprets data which is input by an operation of the touch panel, using a relationship between the position coordinate data and a display image which is displayed by being applied to the display driver 1.

Although not particularly limited, the display driver 1 is formed on a single semiconductor substrate of silicon or the like, using a technology of manufacturing a well-known Complementary Metal-Oxide-Semiconductor (CMOS) field effect transistor semiconductor integrated circuit.

The display driver 1 is configured with a system interface 28, a frame buffer memory 29, a line latch circuit 30, the signal electrode driving circuit 2, a liquid crystal drive level generating circuit 32, a clock generating circuit 23, a command register 24, a sequencer 25, an address counter 26, a timing generating circuit 20, a gradation voltage generating circuit 34, and a scan electrode driving circuit 33. The system interface 28 receives a command or display data which is input from, for example, the host processor via the system bus terminals 27. The received command is transferred to the command register 24, and the display data is stored in the frame buffer memory 29. The clock generating circuit (CPG: Clock Pulse Generator) 23 generates a clock signal which is used in the display driver 1, and supplies the clock signal to the timing generating circuit 20. Based on the command stored in the command register 24, the sequencer 25 generates a control sequence of the whole of the display driver 1. Based on the control sequence, the address counter 26 generates an address for accessing the frame buffer memory 29 and supplies the generated address, and the timing generating circuit 20 supplies a timing control signal to each block in the display driver 1. The liquid crystal drive level generating circuit 32 is configured with, for example, a DC-DC converter, and supplies a power supply which is supplied from an external device via the power supply terminal 31 to each block in the display driver 1 after converting into a necessary voltage level. The gradation voltage generating circuit 34 generates all the gradation voltages which are output as drive voltages corresponding to the display data, and then supplies the gradation voltages to the signal electrode driving circuit 2. The signal electrode driving circuit 2 selects a drive voltage corresponding to the display data among all the gradation voltages which are input, and amplifies a current thereof, and outputs via the drive terminal 3. A detailed configuration example and the operation of the signal electrode driving circuit 2 will be described later. The scan electrode driving circuit 33 outputs the scan pulse signal for driving the scan electrode of the display panel via the scan electrode drive terminal 4. The display data stored in the frame buffer memory 29 is sequentially read one line by one line, and is transferred to a position to be displayed in the line latch circuit 30, and thereafter, further transferred to signal electrode driving circuit 2. The drive voltage corresponding to the display data is output from the signal electrode driving circuit 2 via the drive terminal 3, for each line and for each pixel. If a time-division drive is employed, the drive voltage corresponding to the display data with three colors of RGB which configure one pixel during one line period or with two colors, is output, for example.

In a display mode, the display data may be directly transferred to the line latch circuit 30 from the system interface 28 by bypassing the frame buffer memory 29. In contrast, it is possible to repeatedly read the display data which is stored in the frame buffer memory 29 and to display as a still image. The display driver 1 can also be configured without the frame buffer memory 29 being mounted thereon.

Figure 3:
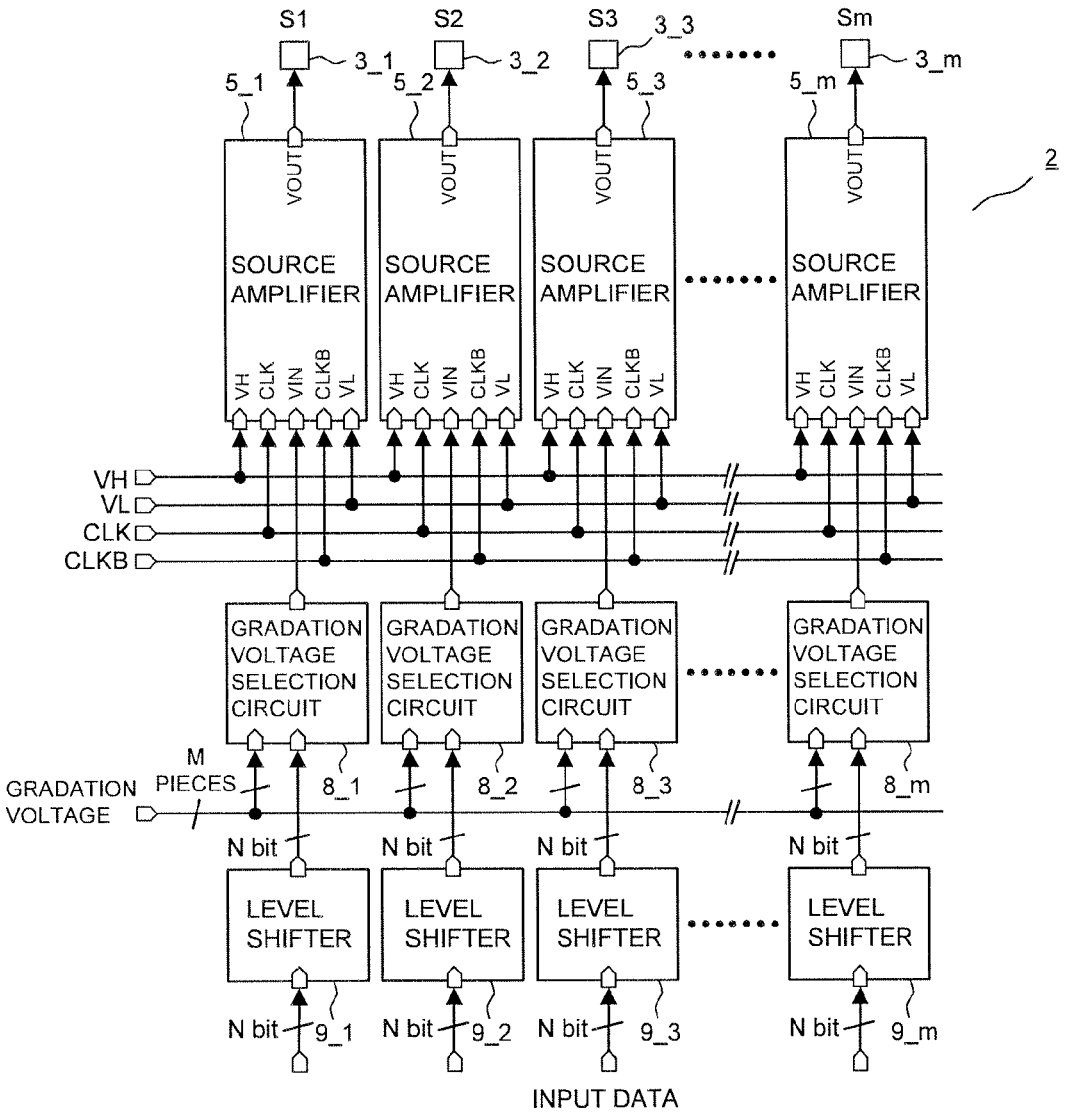
FIG. 3 is a block diagram illustrating a configuration example of a signal electrode driving circuit according to the one embodiment of the present invention.

FIG. 3 is a block diagram illustrating a configuration example of the signal electrode driving circuit 2.

The signal electrode driving circuit 2 is configured by respectively including the source amplifiers 5_1 to **5_*m*, the gradation voltage selection circuits 8_1 to 8_*m*, and the level shifters 9_1 to 9_*m*, for each of the plurality of drive terminals 3_1 to 3_*m* which are coupled to the signal electrodes to be driven. The display data which is supplied from the line latch circuit 30 and corresponds to the drive terminals 3_1 to 3_*m* is converted into signals with appropriate voltage levels by the level shifters 9_1 to 9_*m*, and is supplied to the gradation voltage selection circuits 8_1 to 8_*m*. The plurality of gradation voltages (M pieces in FIG. 3) are supplied to the gradation voltage selection circuits 8_1 to 8_*m*. The gradation voltage selection circuits 8_1 to 8_*m*, based on digital values of the display data which are supplied to each thereof, select one potential level out of the plurality of supplied gradation voltages, and supply the selected one to VIN terminals of the connected source amplifiers 5_1 to 5_*m*. The source amplifiers 5_1 to 5_*m* output the signals with the drive voltages corresponding to the display data to the drive terminals 3_1 to 3_*m*. The drive voltages output from the source amplifiers 5_1 to 5_*m* are supplied to signal electrodes S1 to Sm of the display panel via the drive terminals 3_1 to 3_*m*. A detailed configuration example of the source amplifiers 5_1 to 5_*m*** and operation thereof will be described later.

The drive voltages at the signal electrodes S1 to Sm of the display panel are relatively high voltages of, for example, −5 V to +5 V, while the system interface 28, the frame buffer memory 29, and the line latch circuit 30 can be configured by a digital logic circuit, and thus it is possible to be operated by a relatively low voltage such as 1.4 V. For example, in a CMOS semiconductor integrated circuit, it is preferable that circuits be configured using transistors with breakdown voltages different from each other, depending on the magnitude of an operation voltage thereof. A circuit operating at a low voltage may be configured using low breakdown voltage transistors because the low breakdown voltage transistors can be embedded in a high density. In a portion between the area in which the high breakdown voltage transistor is formed and the area in which the low breakdown voltage transistor is formed, it is necessary for a predetermined buffer area (buffering area) to be provided, and thus considering a layout efficiency, it is desirable that the high breakdown voltage area and the low breakdown voltage area be clearly separated without overlapping with each other. In the display driver 1 illustrated in FIG. 2, the line latch circuit 30 is formed in the low breakdown voltage area. In the signal electrode driving circuit 2 illustrated in FIG. 3, the output portions of the source amplifiers 5_1 to **5_*m*, the gradation voltage selection circuits 8_1 to 8_*m*, and the level shifters 9_1 to 9_*m*, are formed in the high breakdown voltage area. The level shifters 9_1 to 9_*m* convert low voltage signals which are input from the line latch circuit 30 into high voltage signals, and supply the converted signals to the gradation voltage selection circuits 8_1 to 8_*m*. As a result, the high breakdown voltage area in which the output portions of the source amplifiers 5_1 to 5_*m*, the gradation voltage selection circuits 8_1 to 8_*m*, and the level shifters 9_1 to 9_*m* are arranged, and the low breakdown voltage area in which the input portions of the level shifters 9_1 to 9_*m* and the digital circuit such as the line latch circuit 30 which inputs the display data to the level shifters 9_1 to 9_*m*** are formed, are clearly separated without overlapping with each other, and are efficiently laid out.

FIG. 1 is a circuit diagram illustrating a configuration example of the source amplifier 5. The source amplifier 5 is configured with the voltage output circuit 6 and the slew rate assist circuit 7. The voltage output circuit 6, although not particularly limited, is a voltage follower circuit which is configured with, for example, an operational amplifier 10, a positive polarity side output transistor 11, and a negative polarity side output transistor 12. The gradation voltage which is input from the gradation voltage selection circuit 8 to the VIN terminal is input to a positive polarity input terminal of the operational amplifier 10, and the drive voltage is fed back from a VOUT terminal to a negative polarity input terminal of the operational amplifier 10. The voltage follower circuit performs a control for maintaining the VOUT terminal at the same potential as the VIN terminal, and converts an output impedance into a low impedance. A current amplification factor is further improved by the positive polarity side output transistor 11 and the negative polarity side output transistor 12. The positive polarity side output transistor 11 and the negative polarity side output transistor 12 are configured by, for example, a P channel MOSFET and an N channel MOSFET, respectively. A positive polarity side control signal VCP which is coupled to the positive polarity side output transistor 11 from the operational amplifier 10 falls if the VIN rises, when the positive polarity side output transistor 11 is the P channel MOSFET, and is an inverse output of the operational amplifier 10. A negative polarity side control signal VCN which is coupled to the negative polarity side output transistor 12 from the operational amplifier 10 falls if the VIN rises, when the negative polarity side output transistor 12 is the N channel MOSFET, and is an inverse output of the operational amplifier 10. If the N channel MOSFET is also used for the positive polarity side output transistor 11, the positive polarity side control signal VCP is coupled to a non-inverting output terminal of the operational amplifier 10.

The slew rate assist circuit 7, although not particularly limited, can be configured by the voltage follower circuit which is configured by the operational amplifier 13. In one embodiment of the present invention, furthermore, a positive polarity side switch transistor 14 is provided between the positive polarity side control signal output and the VCP of the operational amplifier 13, and a negative polarity side switch transistor 15 is provided between the negative polarity side control signal output and the VCN of the operational amplifier 13. The positive polarity side switch transistor 14 and the negative polarity side switch transistor 15 are configured by, for example, the P channel MOSFET and the N channel MOSFET, respectively. The positive polarity side clock CLK is coupled to a gate of the positive polarity side switch transistor 14, and the negative polarity side clock CLKB is coupled to a gate of the negative polarity side switch transistor 15. Whether to accelerate the transition of the positive polarity side control signal VCP or not is controlled by the positive polarity side clock CLK, and whether to accelerate the transition of the negative polarity side control signal VCN or not is controlled by the negative polarity side clock CLKB. When the positive polarity side switch transistor 14 is turned on by a low level of the positive polarity side clock CLK, the slew rate of the positive polarity side control signal VCP is made larger than that in a case where the VCP is driven only by the operational amplifier 10, and thereby the slew rate of the VOUT is also made large. In the same way also in the negative polarity side, when the negative polarity side switch transistor 15 is turned on by a high level of the negative polarity side clock CLKB, the slew rate of the negative polarity side control signal VCN is made larger than that in a case where the VCN is driven only by the operational amplifier 10, and thereby the slew rate of the VOUT is also made large.

Figure 4:
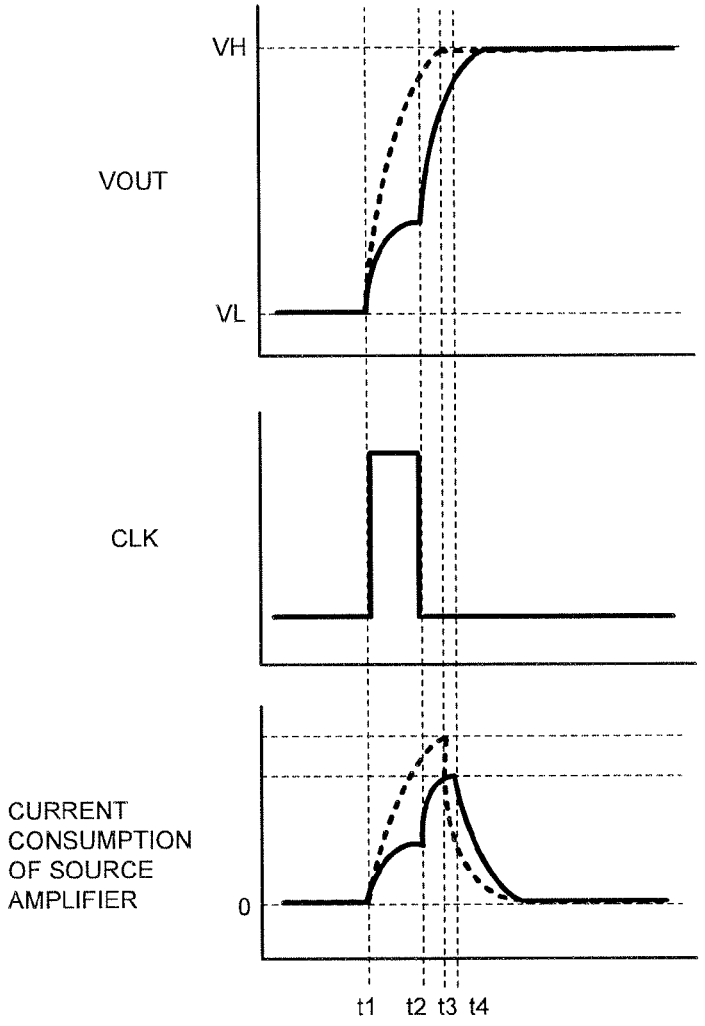
FIG. 4 is a timing diagram illustrating an operation example (positive polarity side) of the source amplifier according to the one embodiment of the present invention.
Figure 5:
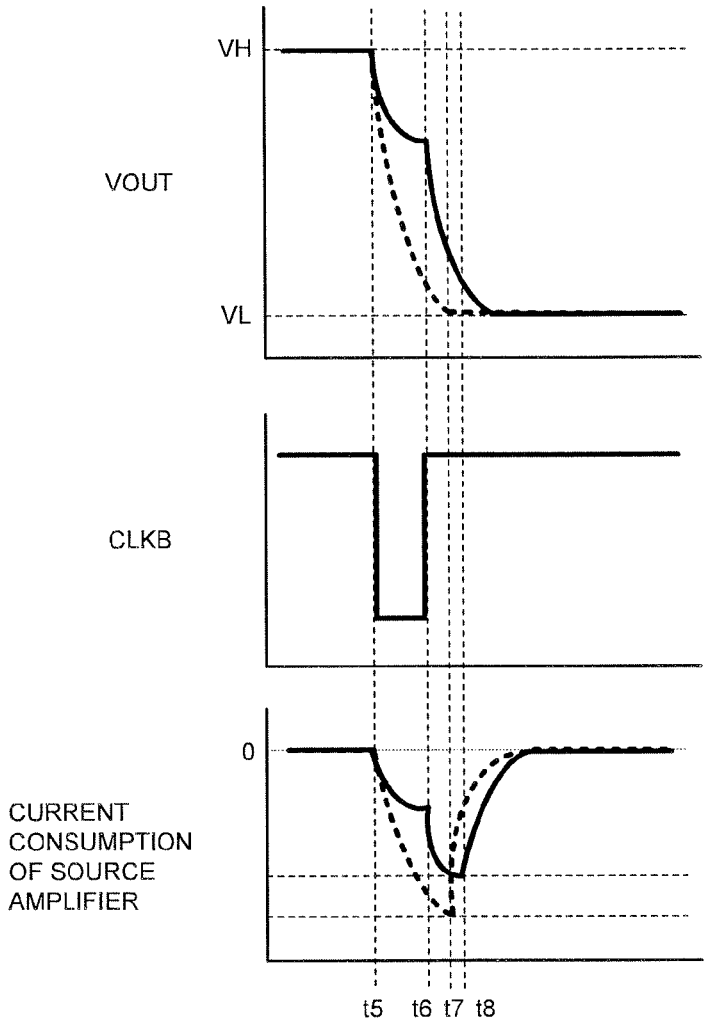
FIG. 5 is a timing diagram illustrating an operation example (negative polarity side) of the source amplifier according to the one embodiment of the present invention.

FIGS. 4 and 5 respectively are timing diagrams illustrating operation examples of the positive polarity side and the negative polarity side of the source amplifier 5.

FIG. 4 illustrates an operation when the VOUT, that is, the drive voltage which drives the signal electrode of the display panel rises, by an operation of the positive polarity side in the source amplifier 5, and FIG. 5 illustrates an operation when the VOUT falls, by an operation of the negative polarity side in the source amplifier 5. In FIGS. 4 and 5, horizontal axes denote time, and from top to bottom in a vertical direction, a VOUT waveform, a waveform of the positive polarity side clock CLK or the negative polarity side clock CLKB, and a current consumption waveform of the source amplifier 5 are illustrated. The current consumption waveform of the source amplifier 5 denotes source line charge and discharge currents occurring at the time of the transition of the rise, the fall or the like of the drive voltage accompanying the source line driving of the display panel, and corresponds to the magnitude of the noise occurring in accordance with the source line driving. In the VOUT waveform and the current consumption waveform of the source amplifier 5, solid lines denote waveforms according to the present invention, and dashed lines denote waveforms of the source amplifier in which the present invention is not employed, and which is used as a comparison example. Here, the source amplifier of the comparison example is configured by the voltage output circuit 6 and the slew rate assist circuit 7, and is configured so as to continually operate, without performing a control for stopping the slew rate assist circuit 7.

In FIG. 4, a case where the gradation voltage which is input to the VIN terminal is transitioned from VL to VH at time t1, is illustrated. The gradation voltage changes the most in a positive direction, that is, it corresponds to a case where the drive voltage rises the most steeply. In order to briefly describe VH and VL as the gradation voltage, the same symbols as the power supply voltages VH and VL of the source amplifier are used, but being the same voltages is not necessary. During the time period between the time t1 when the gradation voltage VIN changes and time t2 when a predetermined time has elapsed from the time t1, the positive polarity side clock CLK is high, and the positive polarity side switch transistor 14 is off, and thus VCP is driven only by the operational amplifier 10. During the time period of the time t1 to the time t2, the slew rate assist circuit 7 does not function. Thereafter, at the time t2, the positive polarity side clock CLK is changed to be low, the positive polarity side switch transistor 14 is turned on, and thereby the slew rate assist circuit 7 functions. During the time period of the time t1 to the time t2 in which the slew rate assist circuit 7 does not operate, the waveform of VOUT has a low slew rate, and thereby the current consumption of the source amplifier is decreased. At the time t2, if the slew rate assist circuit 7 starts to operate, the slew rate of the VOUT becomes high, and thereby the current consumption of the source amplifier is also increased. In contrast, in a case of the source amplifier of the comparison example of the dashed line, the slew rate assist circuit is normally operated, and thus the slew rate of VOUT becomes high from the time t1 when the transition starts, and VOUT reaches VH at time t3. Therefore, the current consumption also increases steeply from the time t1 and decreases steeply from the time t3.

In FIG. 5, the gradation voltage changes the most in a negative direction, that is, a case where the drive voltage falls the most steeply is illustrated. It is a case where the gradation voltage which is input to the VIN terminal is transitioned from VH to VL at time t5. During the time period between the time t5 when the gradation voltage VIN changes and time t6 when a predetermined time has elapsed from the time t5, the negative polarity side clock CLKB is low, and the negative polarity side switch transistor 15 is off, and thus VCN is driven only by the operational amplifier 10. During the time period of the time t5 to the time t6, the slew rate assist circuit 7 does not function. Thereafter, at the time t6, the negative polarity side clock CLKB is changed to be high, the negative polarity side switch transistor 15 is turned on, and thereby the slew rate assist circuit 7 functions. During the time period of the time t5 to the time t6 in which the slew rate assist circuit 7 does not function, the waveform of VOUT has a low slew rate, and thereby the current consumption of the source amplifier is decreased. The current consumption changes in a positive direction in FIG. 4, and changes in a negative direction in FIG. 5, but as an absolute value increases, the current consumption increases. In order to briefly describe, the current consumption during the time period during which VOUT is not transitioned is denoted as zero, but if a predetermined idling current flows, zero of the graphs in FIGS. 4 and 5 denotes a current thereof. If the slew rate assist circuit 7 starts to operate at the time t6, the slew rate of VOUT increases, and thereby the current consumption of the source amplifier also increases. In contrast, in a case of the source amplifier of the comparison example of dashed line, the slew rate assist circuit always operates, and accordingly the slew rate of VOUT increases from the time t5 when the transition is started, and VOUT reaches VL at the time t7. Accordingly, also the current consumption increases steeply from the time t5 and decreases steeply from time t7.

In the rising waveforms illustrated in FIG. 4, the time when the transition ends after VOUT reaches VH is the time t3 in the comparison example, but is the time t4 in the present embodiment. In the falling waveforms illustrated in FIG. 5, the time when the transition ends after VOUT reaches VL is the time t7 in the comparison example, but is the time t8 in the present embodiment. In both cases, the time of the comparison example is earlier. A transition speed of the comparison example is faster, but the peak value of the current consumption of the comparison example decreases greatly compared with the present embodiment. An integral value of the current consumption is equal to each other, but by dispersing a peak of the current, a decrease of the peak value is achieved. As a result, the source line of the display panel is driven, and thereby it is possible to suppress the peak value of the noise which leaks to a peripheral circuit of the touch panel or the like.

Figure 6:
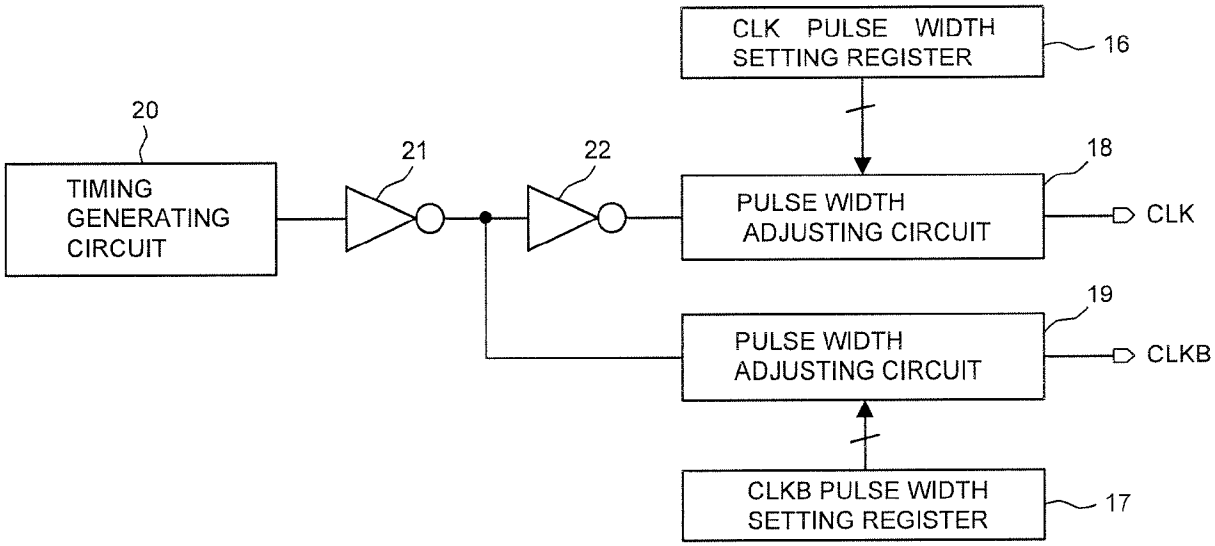
FIG. 6 is a block diagram illustrating a configuration example of a circuit for controlling a slew rate assist circuit according to the one embodiment of the present invention.

FIG. 6 is a block diagram illustrating a configuration example of a circuit for controlling the slew rate assist circuit 7.

The display driver 1 is a circuit for controlling the slew rate assist circuit 7, and includes a CLK pulse width setting register 16 which designates a pulse width of the positive polarity side clock CLK, a pulse width adjusting circuit 18 which adjusts a pulse width of the positive polarity side clock CLK based on a parameter stored in the register, a CLKB pulse width setting register 17 which designates a pulse width of the negative polarity side clock CLKB, and a pulse width adjusting circuit 19 which adjusts a pulse width of the negative polarity side clock CLKB based on a parameter stored in the register. The clock which is supplied from the timing generating circuit 20 is inverted by an inverter 21 and supplied to the pulse width adjusting circuit 19, and is inverted again by an inverter 22 and supplied to the pulse width adjusting circuit 18. As a result, the time period until the slew rate assist circuit 7 starts the acceleration of the transition, that is, the time period t1 to t2 of the positive polarity side in FIG. 4 and the time period t5 to t6 of the negative polarity side in FIG. 5 can be independently and easily set and adjusted on the positive polarity side and the negative polarity side. Since it is possible to independently set and adjust on the positive polarity side and the negative polarity side, it is possible to adjust the characteristics of the positive polarity side and the negative polarity side so as to be symmetrical. If a symmetry property of the characteristics of the positive polarity side and the negative polarity side is destroyed due to manufacturing variation, it is possible to compensate for the destroyed symmetry property.

The pulse width adjusting circuits 18 and 19 can be configured by, for example, counter circuits. In the input clock pulses, only the numbers to be set in the CLK pulse width setting register 16 and the CLKB pulse width setting register 17 are counted, and thereby the pulse widths of CLK and CLKB can be respectively controlled. If the input clock frequency is configured so as not to depend upon the manufacturing variation, a control of the time period until the slew rate assist circuit 7 starts the acceleration operation can also be configured so as not to vary by the manufacturing variation.

The pulse width adjusting circuits 18 and 19 can also be configured using, for example, a logic gate delay. Compared with the above-described configuration example using the clock period, the pulse widths of CLK and CLKB can be changed by an influence of the manufacturing variation and can be adjusted in greater detail. This is because the logic gate delay which is an adjustment unit of the pulse width changes due to the manufacturing variation, but an amount of delay per stage of the logic gate is sufficiently smaller than the clock period.

As described above, the invention made by the present inventor is specifically described based on the embodiments, but it is needless to say that the present invention is not limited thereto and various modifications can be made without departing from the gist thereof.

For example, one source amplifier includes a plurality of slew rate assist circuits, and by controlling the number of slew rate assist circuits to be on and off, the slew rate of the drive voltage is controlled, and then the peak of the current consumption may be dispersed. In addition, without using the slew rate assist circuit, the current drive capability of the voltage output circuit (voltage follower) which configures the source amplifier is adjusted in an analog manner or in a digital manner, thereby the slew rate of the drive voltage is controlled, and then the peak of the current consumption may be dispersed. The current drive capability of the voltage output circuit (voltage follower) can be adjusted by controlling a bias current which is supplied to, for example, the operational amplifier.

What is claimed is:

1. A display driver comprising:

a plurality of drive terminals which are coupled to signal electrodes of a display panel; and a signal electrode driving circuit, wherein the signal electrode driving circuit includes a plurality of source amplifiers which are respectively coupled to the plurality of drive terminals, receive a gradation voltage corresponding to display data, and output a drive voltage corresponding to the gradation voltage to the drive terminals, wherein the source amplifier includes a voltage output circuit which outputs the drive voltage corresponding to an input gradation voltage, and a slew rate assist circuit which accelerates a transition of the output drive voltage of the voltage output circuit, wherein the slew rate assist circuit starts the acceleration after a predetermined time from the start of transition of the output voltage, and the transition starts in response to a start transition of the gradation voltage, wherein the voltage output circuit includes a positive polarity side output transistor, a negative polarity side output transistor, and a first amplification circuit, the positive polarity side output transistor is coupled between a positive polarity side power supply and a drive terminal, the negative polarity side output transistor is coupled between a negative polarity side power supply and the drive terminal, and the first amplification circuit receives the gradation voltage and outputs a positive polarity side control signal which controls a control electrode of the positive polarity side output transistor and a negative polarity side control signal which controls a control electrode of the negative polarity side output transistor, wherein the slew rate assist circuit is configured so as to enable transitions of the positive polarity side control signal and the negative polarity side control signal to be accelerated, wherein the slew rate assist circuit receives a positive polarity side clock and a negative polarity side clock, controls whether or not to accelerate the transition of the positive polarity side control signal based on the positive polarity side clock, and controls whether or not to accelerate the transition of the negative polarity side control signal based on the negative polarity side clock, and wherein the slew rate assist circuit starts the acceleration of the transition of the positive polarity side control signal after a period of a pulse width of the positive polarity side clock from the start of transition of the gradation voltage, and starts the acceleration of the transition of the negative polarity side control signal after a period of a pulse width of the negative polarity side clock from the start of transition of the gradation voltage.

2. The display driver according to claim 1, further comprising:

a first register which designates the pulse width of the positive polarity side clock;

a first pulse width adjusting circuit which adjusts the pulse width of the positive polarity side clock based on a parameter which is stored in the first register;

a second register which designates the pulse width of the negative polarity side clock; and a second pulse width adjusting circuit which adjusts the pulse width of the negative polarity side clock based on a parameter which is stored in the second register.

3. The display driver according to claim 2, wherein the signal electrode driving circuit includes the plurality of source amplifiers, a plurality of gradation voltage selection circuits which are coupled to the plurality of source amplifiers and supply a plurality of gradation voltages with a plurality of potential levels to each of the plurality of source amplifiers, and a plurality of level shifters which are coupled to the plurality of gradation voltage selection circuits, convert levels of digital values of the display data and then supply the converted digital values to each of the plurality of gradation voltage selection circuits, and wherein the plurality of gradation voltages are supplied to the plurality of gradation voltage selection circuits, and the gradation voltage selection circuits, based on the digital value of the display data which is supplied to each of them, select one potential level out of the plurality of gradation voltages supplied and supply the selected potential level to the coupled source amplifier.

4. The display driver according to claim 3, wherein the plurality of source amplifiers, the plurality of gradation voltage selection circuits, and the plurality of level shifters are formed on same semiconductor substrate and have same pitch as the plurality of drive terminals.

5. The display driver according to claim 1, wherein the signal electrode driving circuit includes the plurality of source amplifiers, a plurality of gradation voltage selection circuits which are coupled to the plurality of source amplifiers and supply a plurality of gradation voltages with a plurality of potential levels to each of the plurality of source amplifiers, and a plurality of level shifters which are coupled to the plurality of gradation voltage selection circuits, convert levels of digital values of the display data and then supply the converted digital values to each of the plurality of gradation voltage selection circuits, and wherein the plurality of gradation voltages are supplied to the plurality of gradation voltage selection circuits, and the gradation voltage selection circuits, based on the digital value of the display data which is supplied to each of them, select one potential level out of the plurality of gradation voltages supplied and supply the selected potential level to the coupled source amplifier.

6. The display driver according to claim 5, wherein the plurality of source amplifiers, the plurality of gradation voltage selection circuits, and the plurality of level shifters are formed on same semiconductor substrate and have same pitch as the plurality of drive terminals.

7. A display driver comprising:

a plurality of drive terminals which are coupled to signal electrodes of a display panel; and a signal electrode driving circuit, wherein the signal electrode driving circuit includes a plurality of source amplifiers which are respectively coupled to the plurality of drive terminals, receive a gradation voltage corresponding to display data, and output a drive voltage corresponding to the gradation voltage to the drive terminals, and wherein the source amplifier controls in such a way that a current drive capability with respect to the drive terminal during a first time period after an output start of the drive voltage is lower than a current drive capability with respect to the drive terminal during a second time period before the drive voltage reaches a drive voltage corresponding to the gradation voltage after the first time period, wherein the source amplifier includes a voltage output circuit which outputs the drive voltage corresponding to the input gradation voltage, and a slew rate assist circuit which accelerates a transition of an output voltage of the voltage output circuit, wherein the source amplifier stops the slew rate assist circuit during the first time period and operates the slew rate assist circuit during the second time period, and wherein the display driver further comprises a first register that when the transition of the output voltage rises, defines a length of the first time period during which the slew rate assist circuit stops; and a second register that when the transition of the output voltage falls, defines the length of the first time period during which the slew rate assist circuit stops.

8. A display driver comprising:

a plurality of drive terminals which are coupled to signal electrodes of a display panel; and a signal electrode driving circuit, wherein the signal electrode driving circuit includes a plurality of source amplifiers which are respectively coupled to the plurality of drive terminals, receive a gradation voltage corresponding to display data, and output a drive voltage corresponding to the gradation voltage to the drive terminals, wherein the source amplifier includes a voltage output circuit which outputs the drive voltage corresponding to an input gradation voltage, and a slew rate assist circuit which accelerates a transition of the output drive voltage of the voltage output circuit, wherein the slew rate assist circuit starts the acceleration after a predetermined time from the start of transition of the output voltage, and the transition starts in response to a start transition of the gradation voltage, wherein the voltage output circuit includes a positive polarity side output transistor, a negative polarity side output transistor, and a first amplification circuit, the positive polarity side output transistor is coupled between a positive polarity side power supply and a drive terminal, the negative polarity side output transistor is coupled between a negative polarity side power supply and the drive terminal, and the first amplification circuit receives the gradation voltage and outputs a positive polarity side control signal which controls a control electrode of the positive polarity side output transistor and a negative polarity side control signal which controls a control electrode of the negative polarity side output transistor, wherein the slew rate assist circuit is configured so as to enable transitions of the positive polarity side control signal and the negative polarity side control signal to be accelerated, wherein the slew rate assist circuit receives a positive polarity side clock and a negative polarity side clock, controls whether or not to accelerate the transition of the positive polarity side control signal based on the positive polarity side clock, and controls whether or not to accelerate the transition of the negative polarity side control signal based on the negative polarity side clock, wherein the slew rate assist circuit starts the acceleration of the transition of the positive polarity side control signal after a period of a pulse width of the positive polarity side clock from the start of transition of the gradation voltage, and starts the acceleration of the transition of the negative polarity side control signal after a period of a pulse width of the negative polarity side clock from the start of transition of the gradation voltage, wherein the signal electrode driving circuit includes the plurality of source amplifiers, a plurality of gradation voltage selection circuits which are coupled to the plurality of source amplifiers and supply a plurality of gradation voltages with a plurality of potential levels to each of the plurality of source amplifiers, and a plurality of level shifters which are coupled to the plurality of gradation voltage selection circuits, convert levels of digital values of the display data and then supply the converted digital values to each of the plurality of gradation voltage selection circuits, and wherein the plurality of gradation voltages are supplied to the plurality of gradation voltage selection circuits, and the gradation voltage selection circuits, based on the digital value of the display data which is supplied to each of them, select one potential level out of the plurality of gradation voltages supplied and supply the selected potential level to the coupled source amplifier.

9. The display driver according to claim 8, wherein the plurality of source amplifiers, the plurality of gradation voltage selection circuits, and the plurality of level shifters are formed on same semiconductor substrate and have same pitch as the plurality of drive terminals.

* * * * *